United States Patent [19]

Hewett et al.

[11] 4,064,813

[45] Dec. 27, 1977

[54] SHELVES

[75] Inventors: Alan R. Hewett; Leonard T. Robilliard, both of Hemel Hempstead, England

[73] Assignee: Dexion-Comino International Limited, Middlesex, England

[21] Appl. No.: 733,988

[22] Filed: Oct. 20, 1976

[30] Foreign Application Priority Data

Oct. 22, 1975 United Kingdom ..... 43392/75

[51] Int. Cl.[2] ..... A47B 57/00

[52] U.S. Cl. ..... 108/60; 211/135; 211/153

[58] Field of Search ..... 108/60; 211/135, 153, 211/184; 248/247, 248

[56] References Cited

U.S. PATENT DOCUMENTS

| | | | |
|---|---|---|---|
| 2,933,195 | 4/1960 | Rader | 211/153 |
| 2,934,215 | 4/1960 | Mogulescu et al. | 211/184 X |
| 3,549,019 | 12/1970 | Wood et al. | 211/135 |
| 3,698,568 | 10/1972 | Armstrong | 211/184 |

*Primary Examiner*—James C. Mitchell

*Attorney, Agent, or Firm*—Pollock, Vande Sande & Priddy

[57] ABSTRACT

The invention concerns a shelf comprising a shelf panel and at least one flange consisting of a first portion dependent from the panel and a second portion laid against the inside of the first portion and closely against a marginal portion of the underside of the panel. Advantageously an inwardly projecting hollow bulge is provided at the lower edge of the flange. Holes may be provided in the shelf panel and flange for receiving supporting means for a shelf divider. A shelf assembly may comprise a shelf with flanges at front and back, and a shelf divider mounted upon the shelf by rods which are carried by the divider and engage in holes in the shelf panel and in the front and back flanges respectively.

16 Claims, 10 Drawing Figures

SHELVES

This invention concerns improvements relating to flanged shelves and members of like panel shape, hereinafter referred to as shelves.

According to the invention, a shelf comprises a shelf panel and flange consisting of a first portion dependent from the panel and a second portion laid against the inside of the first portion and bent over to lie closely against a marginal portion of the underside of the panel.

Preferably, in such a shelf made of sheet steel, the flange is formed by folding the material of the flange inwardly at the lower edge and bending over a narrow marginal portion thereof inwardly under the panel. An inwardly projecting hollow bulge may be provided at the lower edge of the flange where it is folded inwardly. As an alternative for the bulge, a double-thickness horizontal flange portion may be provided at the said lower edge. Generally such flanges will be provided at the front and back edges only of a shelf.

A shelf with flanges of the kind set forth has increased strength which may be disproportionately greater than the increase in material used. In practice, this may permit of higher loading of the shelf and/or economy with respect to the gauge of the shelf material.

The use of a flange of the kind set forth need involve no loss in the facility and versatility of use of the shelf, particularly with respect to the possibilities as to its releasable attachment to a framework or uprights, for instance by bolting to slotted-angle members.

The flange also offers an advantageous facility for the releasable mounting of shelf-dividers or partitions by means of rods attached to the dividers and entered through holes in the shelf panel and in the upper sides only of the aforesaid hollow bulges. The rods may be disposed obliquely so that they are inclined away from the flange in the upward direction. In this case one of a pair of oppositely inclined rods may be fixed in the divider, for example by oppositely punched out half loops of material of the divider panel. The other may be mounted slidably, in similar loops or otherwise so as to have a retractable bolt action. Its upper end may be bent over at right angles to form a small handle.

Examples of ways of carrying the invention into practice will now be more fully described with reference to the accompanying drawings, in which.

Figure 5:
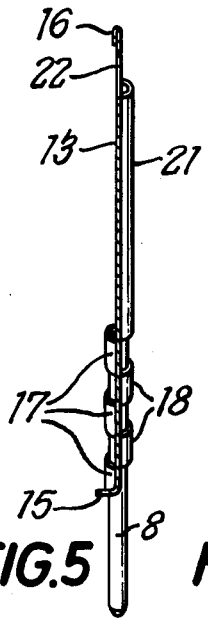
Figure 6:
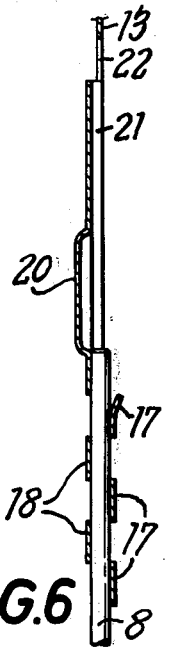
Figure 2:
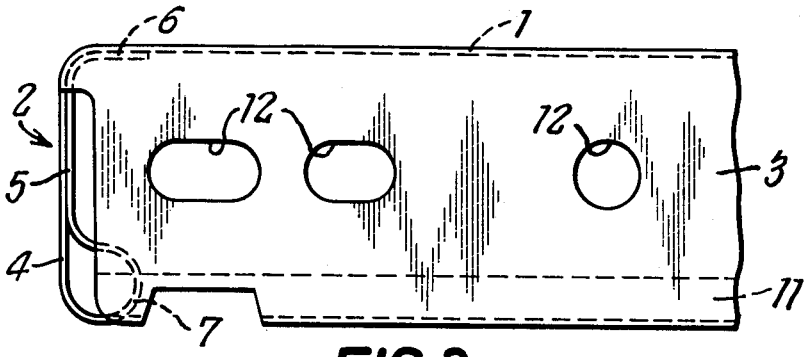
FIG. 2 is an end view of part of the shelf to a smaller scale.
Figure 3:
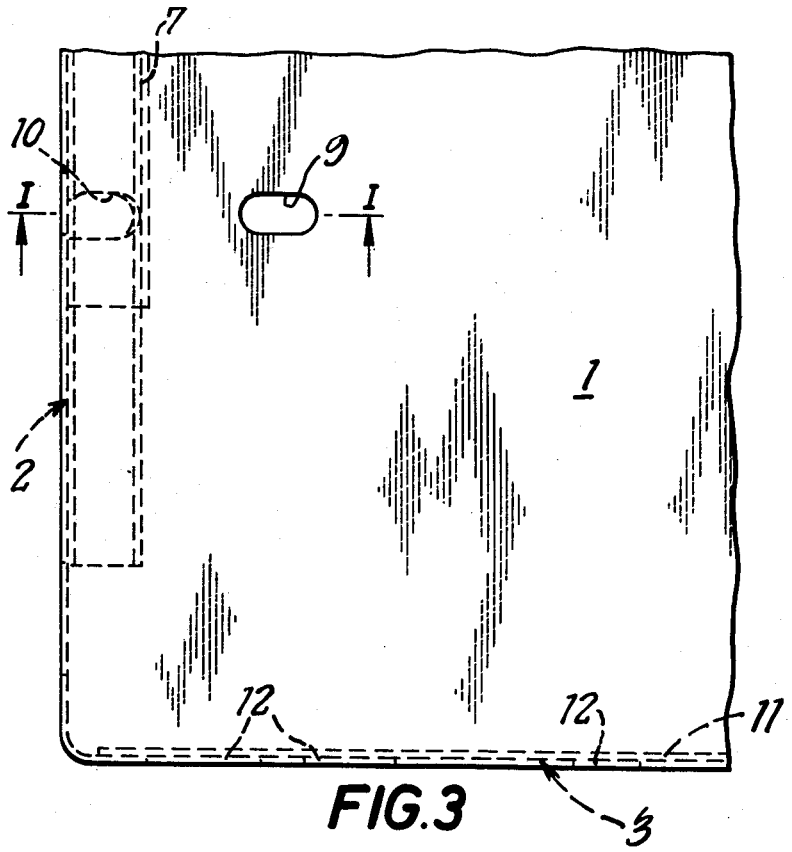
Figure 4:
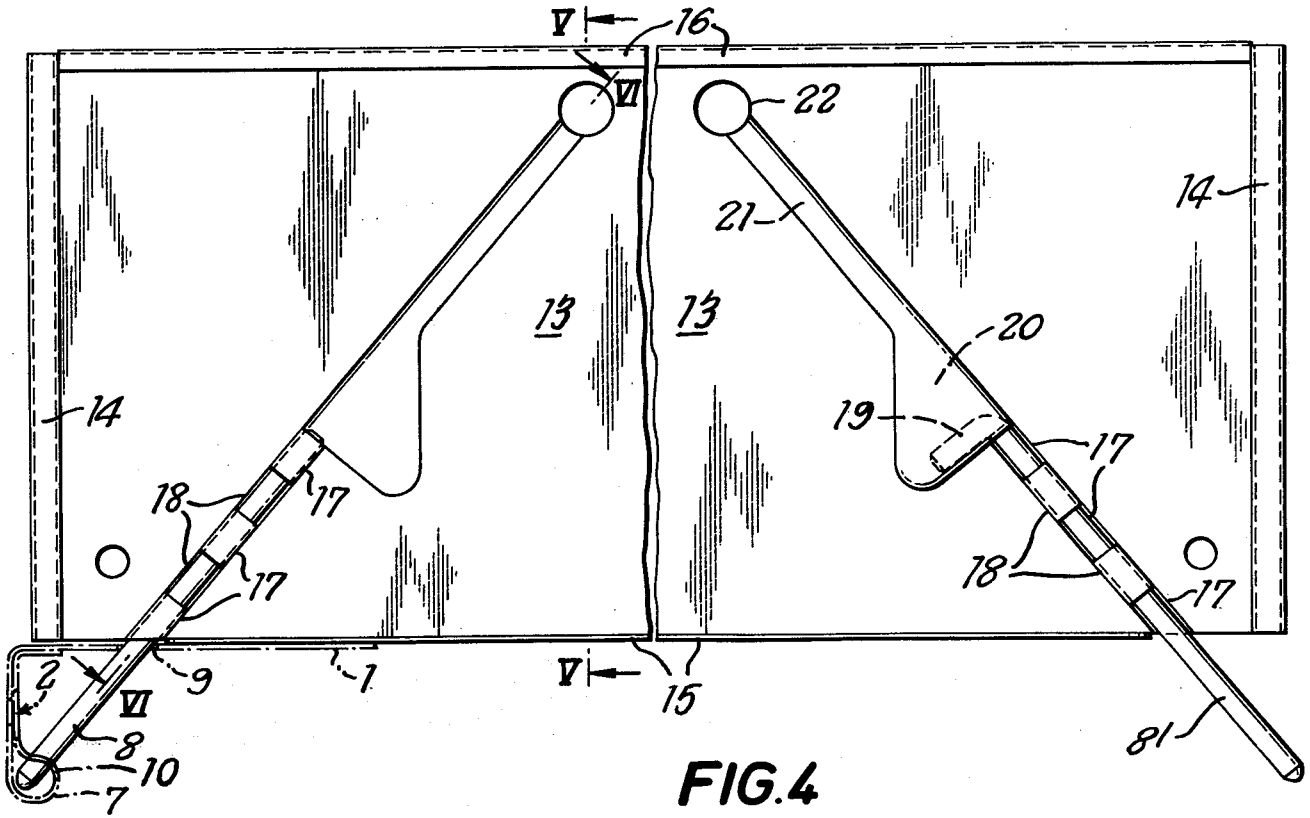
Figure 7:
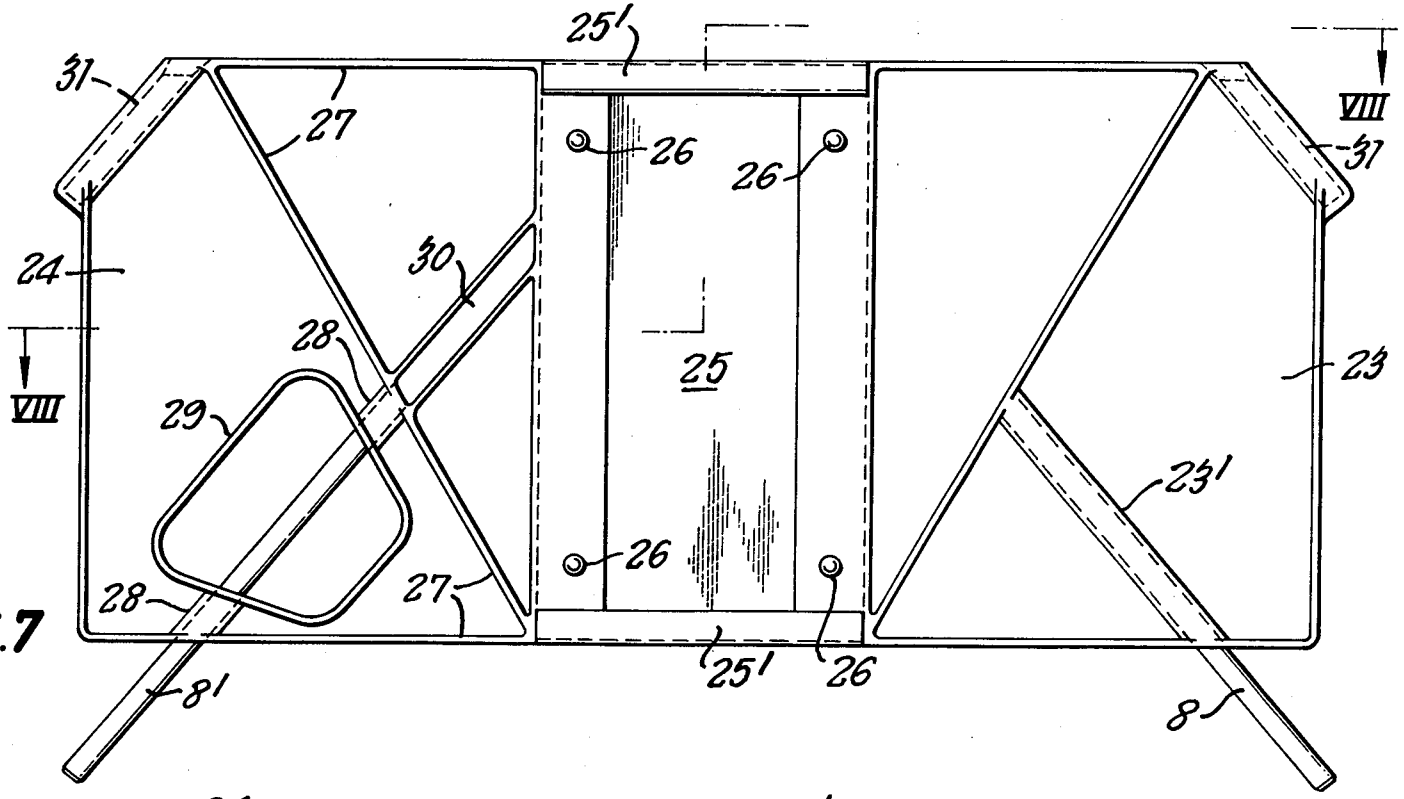
Figure 8:
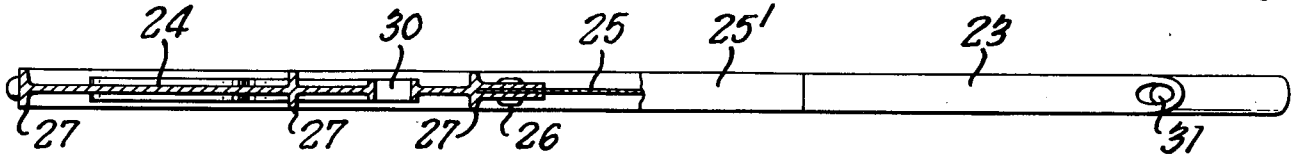
Figure 9:
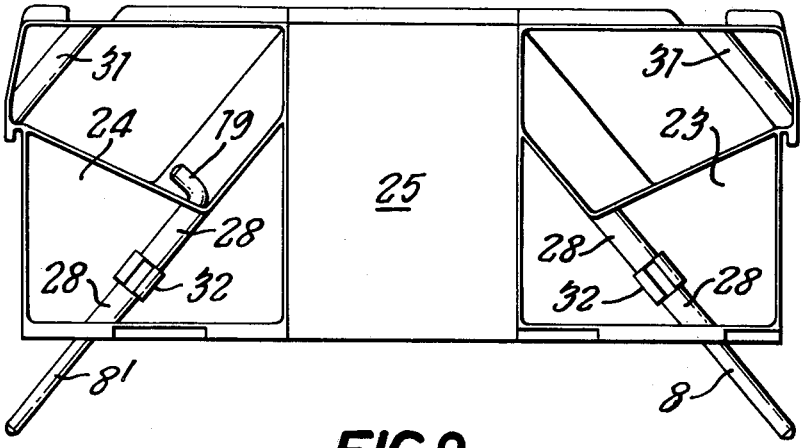

FIG. 3 a plan view corresponding to FIG. 2;

FIG. 4 is an elevational view of a shelf divider, illustrating means for its releasable mounting;

FIG. 5 is a view, to yet a smaller scale, of the mounting means as seen on the line V — V in FIG. 4;

FIG. 6 is a section on the line VI — VI in FIG. 4,

FIG. 7 is an elevation of a different construction of divider;

FIG. 8 is a part plan view part horizontal section on the line VIII — VIII in FIG. 7;

FIG. 9 is an elevation of a third construction of divider; and

Figure 1:
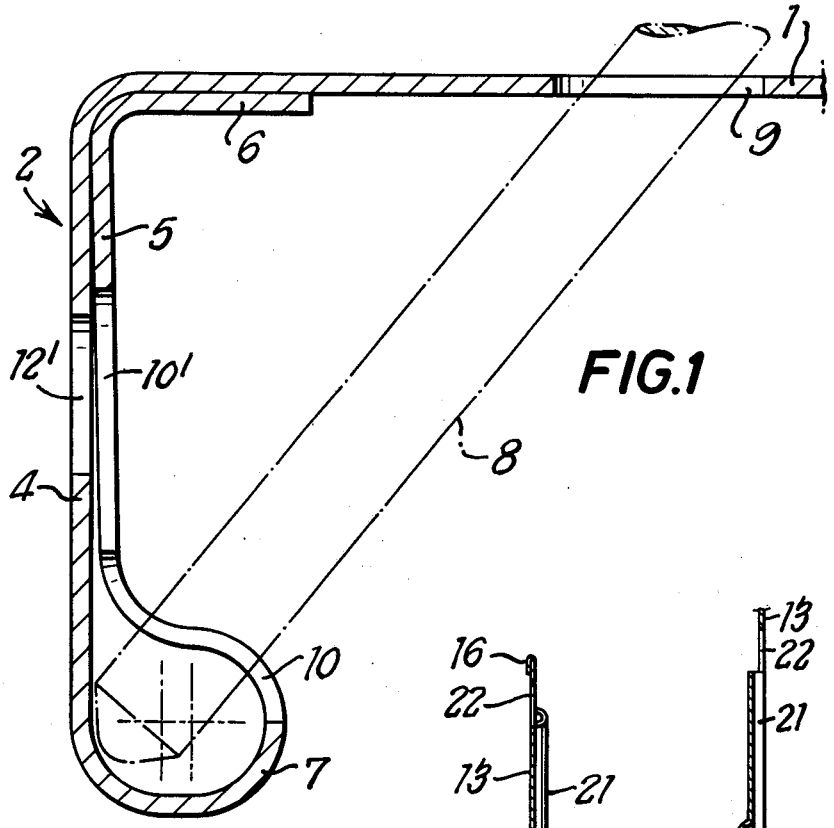
FIG. 1 is a section, on the line I — I in FIG. 3, through an edge portion of a shelf and flange.
Figure 10:
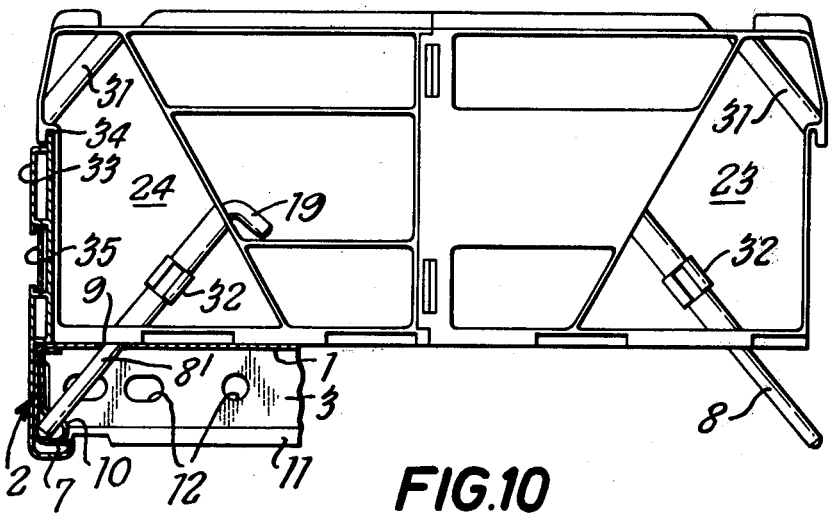

FIG. 10 is a similar view of a fourth such construction, partially in vertical section. FIGS. 1 to 3 illustrate a corner part of a shelf pressed from a blank sheet of steel and consisting of a shelf panel 1, flanges 2 at the front and rear and flanges 3 at the ends or sides (only the front and one end flange are shown). A flange 2 consists of a first portion 4 dependent from the panel 1 and a second portion 5 formed by bending the material inwardly at the lower edge, laying the portion 5 back against the inside of the portion 4 and bending over a narrow edge portion 6 against a marginal part of the panel 1, the bends at the corner being radiused to permit snug fitting there.

As illustrated, an inwardly projecting hollow bulge 7 is formed at the lower edge of the flange 2 where it is turned inwardly. For receiving an inclined supporting rod 8 for a shelf divider to be described, an elongated hole 9 is provided in the panel 1 and an elongated hole 10 in the upper side only of the bulge 7.

The flanges 3 at the ends of the shelf could be plain single flanges with or without additional stiffening means, as required. In the example illustrated, however, they have a narrow double-thickness margin 11 (FIGS. 2 and 3) formed by folding the flange material inwardly. The flanges 2, 3 may be provided with round and/or elongated holes for the releasable attachment of the shelf to a framework or uprights. The holes 12 shown by way of example in FIGS. 2 and 3 would be suitable for bolting to slotted angle, but any arrangement of holes to suit uprights or framework elements of other kinds may be provided. If the position of a hole in the flange 2, such as the hole 12′ (FIG. 1) in the flange portions 4 corresponds with the position of the hole 10 the necessary opening in the flange portion 5 may be provided by an upward extension 10′, of the hole 10, narrower than the latter hole. Known corner formations, such as that indicated by way of example in FIGS. 2 and 3, may be provided if required by a particular shelving system.

A shelf divider or partition shown in FIG. 4 consists of a sheet-steel panel 13 with circularly rolled ends 14, a base flange 15 to rest on the shelf panel 1 and a folded-over stiffening margin 16 at the top. It is releasably mounted on the shelf by means of a pair of steel-wire rods 8, 8′ engaged with the divider panel 13 and entered, as shown in FIG. 1 and for the left-hand rod 8 in FIG. 4, through a hole 9 in the shelf panel 1 and a hole 10 in the flange bulge 7. The rods 8, 8′ are disposed with opposite inclination upwardly away from the respective flange 2. One rod of a pair, the rod 8 in FIG. 4, is fixed in relation to the divider panel 13 by being crimped in half-loops 17, 18 punched out to opposite sides of the panel, three half-loops 17 to one side and alternate loops 18 to the other side.

The other rod 8′ is mounted in longitudinally slidable fashion in similar half-loops 17, 18 so as to have a retractable bolt action. To facilitate manipulation, its upper end 19 is bent over to form a handle which can be accommodated in an out-of-the-way position in an elongated depression 20 formed in the panel 13. A channel 21 for guiding the rod 8′ when retracted upwardly and a hole 22 in which the handle 19 can be lodged, when retracted, are also provided. The features 20, 21 and 22 are duplicated on the left-hand side, in FIG. 4, of the panel to afford versatility in use, but are not actually utilized in the case of the rod 8. To mount a divider on a shelf, it is only necessary to move the divider panel 13 obliquely so that the rod 8 passes through the hole 9 into the hole 10 and becomes lodged in the bulge 7 of the respective flange 2. During this operation the rod 8′ is held in its retracted position by its handle 19, lodged in the hole 22. The rod 8′ is then released and slid obliquely downwardly to occupy a position, in the opposite flange 2 (not shown), which is a mirror image of the position shown in FIG. 4 for the rod 8. The divider is thus secured in its required position.

If desired, use could alternatively be made of two slidable rods 8' for mounting a divider.

A common design for the rods 8, 8' and of the associated features 17, 18 and 20–22 for receiving the rods, produced by the same tooling, can be used for a range of taller dividers, in which case only lower portions of such dividers are utilised for the mounting of the latter.

If required, the rolled ends 14 of a divider, can be utilized for the reception of additional locating or supporting elements, for example for the addition of a section for increasing the height of a divider.

Dividers may alternatively be made wholly or in part of a plastics material. An example (FIGS. 7 and 8) of a composite construction consists of end portions 23, 24 of injection-moulded plastics material and an insert portion 25 of sheet steel. The insert 25 may be moulded into the end portions 23, 24 and/or secured therein by rivets 26. The end portions may be injection moulded with appropriate stiffening flanges 27 where required and with provision for a fixed steel mounting rod 8, moulded or otherwise secured in a hole in a rib formation 23' on the end portion 23, and for a slidable rod 8' on the end portion 24. The end portion 24 is moulded with guides 28 in which the rod 8' can slide, and opening 29 affording finger access for moving the rod and an open channel 30 for accommodating a handle 19, if provided. Blind holes 31 disposed with the same obliquity as the rods 8, 8' may be formed, as shown, at the upper corners of the divider, so that the divider height can be increased by a further section mounted by rods similar to the rods 8, 8'. Rolled flanges 25' may be provided on the top and bottom of the insert 25 to stiffen the panel. An extruded plastics sheet may be used in place of the sheet-metal insert 25. Using standard end portions 23, 24, dividers of different lengths can be obtained by employing inserts of metal or plastics of different lengths.

A divider (not shown) may be made as a single injection-moulded plastics component comprising triangular end portions designed similarly to those of FIG. 7 with respect to the provisions for rods 8, 8' and a rectangularly corrugated intermediate portion of less thickness.

FIG. 9 illustrates a three-piece all-plastics divider in which parts serving similar functions are indicated by the same references as in FIG. 7. For different lengths of dividers, the end sections 23, 24, suitably mouldings, may remain of standard length, whilst insert portions 25, suitably extrusions, of different lengths are provided. However, three mouldings may alternatively be employed. The rod-holding means of the sections 23, 24 are generally the same as in FIG. 7. They include clamping formations 32, one of which is closed to grip this rod 8, whereas the other is left unclosed to permit sliding of the rod 8'.The three sections may be connected together by riveting or a clipping arrangement.

Finally, FIG. 10 illustrates a two-piece all-plastics divider in position on a shelf panel 1 and provided with a plastic bin front 33, suitably a rigid polyvinyl-chloride extrusion. The arrangements for the rods 8, 8' are similar to those in FIG. 9, but the two sections 23, 24, suitably identical mouldings, are directly abutted and secured together by interengaging clip formations. The bin front 33 is clipped at the top under a lip 34 on the front divider section and at the bottom over the bulge 7 on the shelf flange 2. An undercut recess 35 for receiving a card identifying the shelf or its contents is provided.

We claim:

1. A shelving apparatus comprising:
a shelf panel,
an edge flange formed integrally with said shelf panel,
said flange comprising a first portion depending from said panel and a second portion which lies against the inside of the first portion and extends to and beyond the line of junction of said first portion with said shelf panel,
said second portion lying also against a marginal portion only of the underside of said panel.

2. The shelving apparatus according to claim 1, wherein the shelf panel is of sheet metal, which is bent down to form the first flange portion, folded inwardly at the lower edge of the latter and bent over inwardly so that a narrow edge portion bears closely against the underside of the panel.

3. The shelving apparatus of claim 1 wherein said flange at the junction of its said first and second portions is formed with a bulge of rounded cross-section.

4. The shelving apparatus according to claim 1, wherein holes are provided in the shelf panel and flange for receiving supporting means for a shelf divider.

5. The shelving apparatus according to claim 1, wherein an inwardly projecting hollow bulge is formed at the junction of said first and second portions and holes are provided in the shelf panel and in the upper part of the bulge in positions for receiving an obliquely located rod for supporting a shelf divider.

6. The shelving apparatus of claim 1 including a flange at the front and back of said shelf panel and which further includes, a shelf divider, and divider supports in the form of rods which are carried by the divider and engage in holes in the shelf panel and in holes in the front and back shelf flanges respectively.

7. Shelving apparatus according to claim 6, wherein said divider is supported by a pair of said rods and at least one of said rod of the pair is slidable with a bolt action longitudinally in guiding means on the divider.

8. Shelving apparatus according to claim 6, wherein said divider is supported by a pair of said rods and one said rod of a pair is fixed in the divider and the other is slidable with a bolt action longitudinally in guiding means on the divider.

9. Shelving apparatus according to claim 6 and comprising rod-carrying means in the form of the series of alternately oppositely directed half- loop formations produced from the material of the divider and embracing a respective rod.

10. Shelving apparatus according to claim 6, wherein (a) at least one said rod has a handle for its manipulation and the divider has a recess for receiving the handle when the rod is projected to an operative position and a hole for receiving the handle and retaining the rod in a retracted inoperative position.

11. Shelving apparatus according to claim 6, wherein the divider comprises a one-piece divider panel.

12. Shelving apparatus according to claim 6, wherein the divider is composed of at least two connected panel sections.

13. Shelving apparatus according to claim 6, wherein the divider is composed of at least two connected panel sections and rod-carrying means are provided on respective said sections.

14. Shelving apparatus according to claim 6, wherein the divider comprises an intermediate panel section between plastic end sections.

15. Shelving apparatus according to claim 6, wherein the divider comprises end sections adapted for being used in conjunction with intermediate sections of different lengths.

16. Shelving apparatus according to claim 6, wherein the divider is adapted for receiving an additional upper section for increasing its height.

* * * * *